US007010141B2

(12) United States Patent
Sugiura et al.

(10) Patent No.: US 7,010,141 B2
(45) Date of Patent: Mar. 7, 2006

(54) SPEAKER DEVICE

(75) Inventors: Hideaki Sugiura, Yamagata (JP); Taizo Nakata, Osaka (JP); Tetsuo Nishikawa, Yamaguchi (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 161 days.

(21) Appl. No.: 10/717,642

(22) Filed: Nov. 21, 2003

(65) Prior Publication Data

US 2004/0109582 A1 Jun. 10, 2004

(30) Foreign Application Priority Data

Dec. 6, 2002 (JP) ..... P2002-355182

(51) Int. Cl.
*H04R 25/00* (2006.01)

(52) U.S. Cl. ..... 381/404; 381/398; 381/396

(58) Field of Classification Search ..... 381/386, 381/395, 396, 398, 403–404; 181/171–172
See application file for complete search history.

(56) References Cited

U.S. PATENT DOCUMENTS 1,957,562 A 5/1934 Tolerton
2,235,187 A 3/1941 Wilson
4,531,025 A * 7/1985 Danley et al. ..... 381/404
6,173,065 B1 * 1/2001 Lin ..... 381/404
6,176,345 B1 * 1/2001 Perkins et al. ..... 18/171
6,385,327 B1 * 5/2002 D'Hoogh ..... 381/404
2002/0148678 A1 * 10/2002 Sahyoun ..... 181/171

FOREIGN PATENT DOCUMENTS

GB 375 010 A 6/1932

* cited by examiner

*Primary Examiner*—Suhan Ni
(74) *Attorney, Agent, or Firm*—Sughrue Mion, PLLC

(57) ABSTRACT

In a speaker device 10 having: a magnetic circuit 13 including a magnet 14 and a yoke 11; a voice coil 16 which is placed in a magnetic gap 12 of the magnetic circuit 13; and a diaphragm 17 which is vibrating available in a state where the diaphragm is coupled with the voice coil 16, a peripheral edge of the diaphragm 17 being fixed to a housing 20, a damper holder 30 is disposed in a portion where a damper 27 is attached to the housing 20. The damper holder 30 is in point contact with the housing 20 via three or more projections 31 which are disposed on one of the damper holder 30 and the housing 20. Preferably, the damper holder 30 is made of a hybrid material of a resin (polypropylene) and tungsten, and has a specific gravity of 10.0 or larger.

5 Claims, 4 Drawing Sheets

SPEAKER DEVICE

CROSS REFERENCE OF RELATED APPLICATION

This application is based on and claims priority under 35 U.S.C. §119 with respect to Japanese Patent Application No. 2002-355182 filed on Dec. 6, 2002, the entire content of which is incorporated herein by reference.

BACKGROUND OF THE INVENTION

1. Field of the Invention

The present invention relates to a speaker device.

2. Description of the Related Art

Conventionally, various kinds of speaker devices have been disclosed (for example, see JP-B-56-15196 (page 1, FIG. 1) and JP-UM-A-57-106387 (pages 2 and 3, FIG. 1).

FIG. 1 shows an example of a speaker device which is recently often used as a home device or an in-vehicle device. The speaker device 100 is driven by the moving coil system. An annular magnet 104 is placed on a pole yoke 106, and an annular plate 105 is placed on the annular magnet 104. The pole yoke 106, the annular magnet 104, and the annular plate 105 form a magnetic circuit 107.

A voice coil 102 which is wound around an end portion of a voice coil bobbin 103 is placed in a magnetic gap 107*a* of the magnetic circuit 107. The voice coil bobbin 103 is fixed to a center hole of a cone paper 101 which is a substantially conical diaphragm. A cap 113 is attached to the center hole. An edge 108 is disposed in an outer peripheral portion of the cone paper 101, and attached to an outer peripheral edge of a frame 112 via a paper gasket 114.

A center portion of the cone paper 101 is supported by the frame 112 via a damper 109, so that the cone paper 101, the voice coil 102, and the voice coil bobbin 103 are vibrating available in an integrated state in the direction of the center axis X of the speaker device 100.

Positive and negative input terminals 110 are attached to the frame 112. The ends of the voice coil 102 are electrically connected to the positive and negative input terminals 110 via lead wires (tinsel wires) 111, respectively.

A driving signal (driving current) is supplied from an external power source to the input terminals 110. In the magnetic gap 107*a* of the magnetic circuit 107, the voice coil 102 then receives an electromagnetic driving force corresponding to the driving signal. As a result, the voice coil 102 is vibrated in the direction of the center axis X of the speaker device 100, integrally with the voice coil bobbin 103 and the cone paper 101, so that an acoustic energy corresponding to the driving signal is radiated from the cone paper 101.

Alternatively, an exciting coil which functions as an electromagnet may be used in place of the magnet 104 to form the magnetic circuit.

In the above-described conventional art, the outer peripheral edge of the damper 109 is bonded to the frame 112. Therefore, resonance of the damper 109 and the frame 112 are transmitted through the damper 109 to be returned to the voice coil 102, thereby causing a problem in that a sound which is delayed and distorted is transmitted to the cone paper 101 to impair the sound quality.

The present invention has been made to solve the above problems, and therefore an object of the invention is to transmit resonance of the damper and the frame through the damper to be returned to the voice coil, thereby impairing the sound quality.

To achieve the above object, according to the invention, there is provided a speaker device comprising: a magnetic circuit including a magnet and a yoke; a voice coil which is placed in a magnetic gap of the magnetic circuit; a diaphragm which is vibrating available in a state where the diaphragm is coupled with the voice coil; and a damper which is placed between a portion of the diaphragm on a side of the voice coil and a housing, wherein the speaker device has a damper holder which is disposed on the housing, and to which the damper is connected, and the housing and the damper holder are in contact with each other via projections which are disposed on one of the housing and the damper holder.

BRIEF DESCRIPTION OF THE DRAWINGS

These and other objects and advantages of this invention will become more fully apparent from the following detailed description taken with the accompanying drawings in which:

FIG. 4 is a rear view as viewed in the direction of

DETAILED DESCRIPTION OF THE PREFERRED EMBODIMENTS

Figure 1:
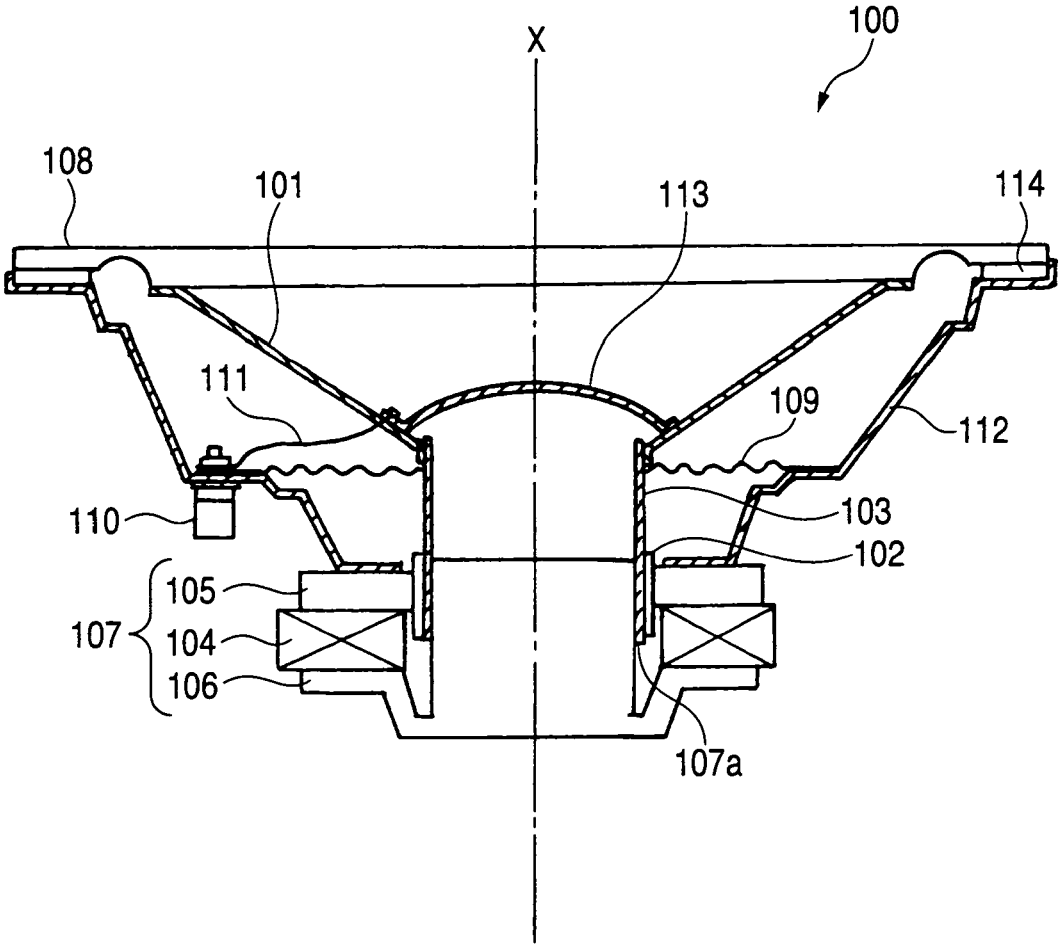
FIG. 1 RELATED ART
FIG. 1 is a section view showing a conventional speaker device.
Figure 2:
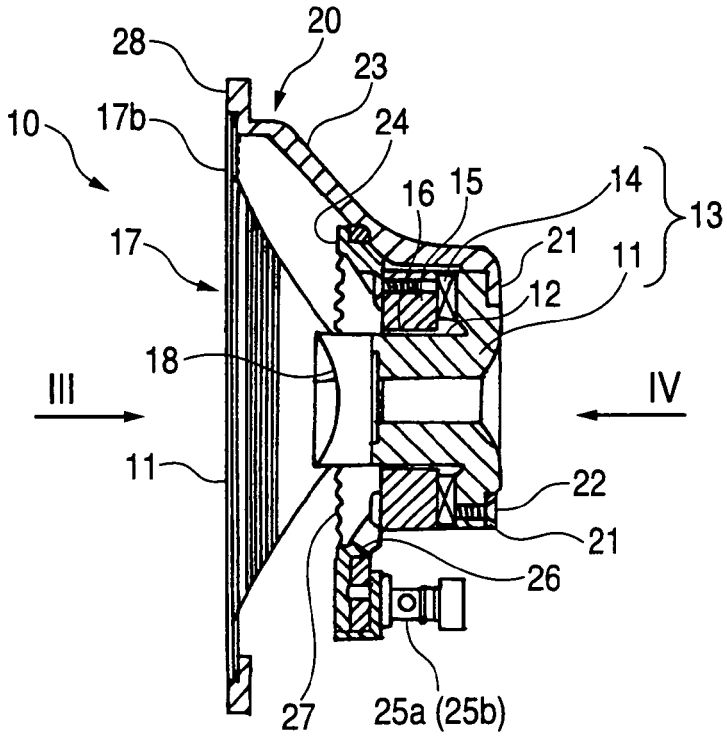
FIG. 2 is a section view showing an embodiment of the speaker device of the invention.
Figure 3:
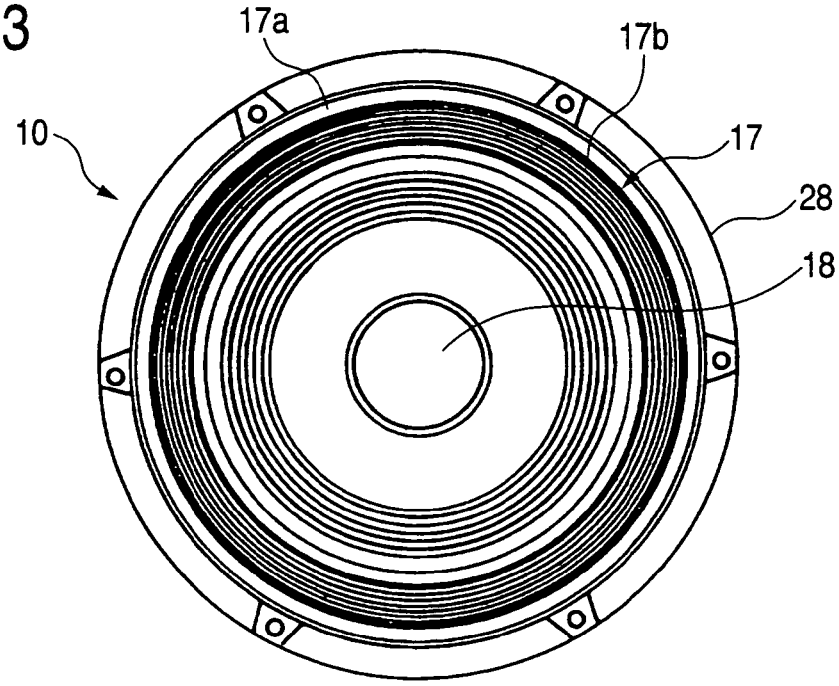
FIG. 3 is a front view as viewed in the direction of III in FIG. 2.
Figure 4:
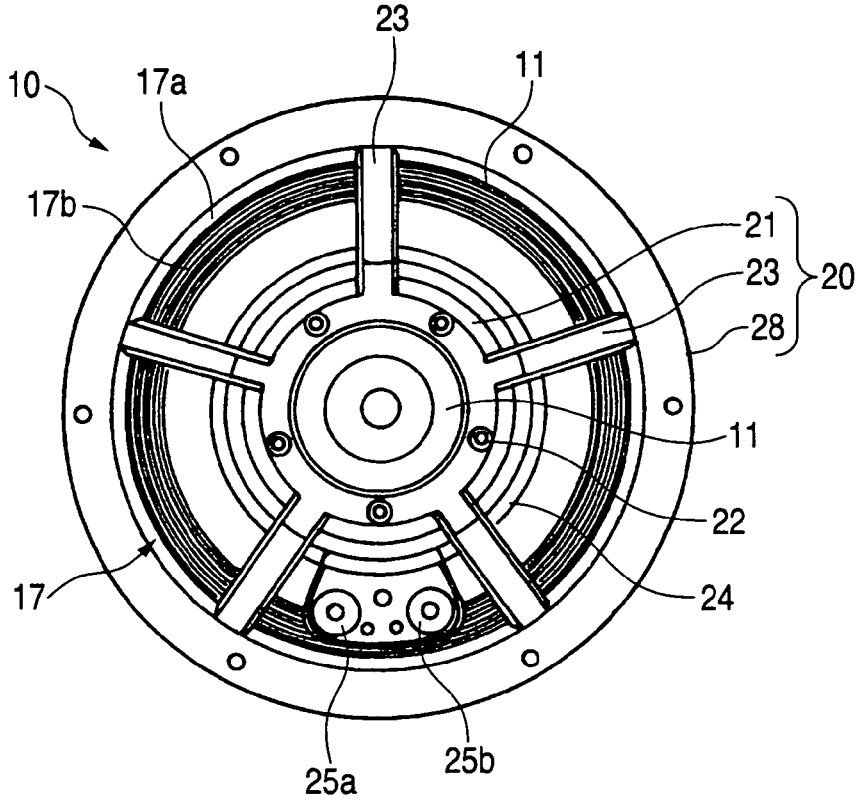

An embodiment of the invention will be described with reference to the accompanying drawings. FIG. 2 is a section view of the speaker device of the invention, FIG. 3 is a front view of the speaker device, and FIG. 4 is a rear view of the speaker device.

The speaker device 10 has a yoke 11 in a center portion, and an annular magnet 14 and an annular plate 15 are outside the yoke 11. These components constitute a magnetic circuit 13 while forming a magnetic gap 12 between the plate and the yoke 11. The magnet 14 may be excited by a DC power source, or alternatively may be configured by using a permanent magnet.

A voice coil 16 which is formed by a thin copper wire is disposed in the magnetic gap 12 so as to be movable backward and forward. The voice coil 16 is attached to a center hole of a cone paper 17 which is a substantially conical diaphragm. A cap 18 is attached in front of the center hole of the cone paper 17.

A circular attachment face 21 which constitutes a frame 20 serving as a housing is attached to the rear face of the yoke 11 by screws 22. Plural (in the embodiment, five) arms 23 are disposed so as to forward extend from the attachment face 21 in a radial manner to surround the yoke 11 and the magnet 14.

A terminal support ring 24 is attached to intermediate positions of the arms 23. A pair of positive and negative speaker terminals 25*a*, 25*b* are attached to a lower portion of the terminal support ring 24. The voice coil 16 is electrically connected to the positive and negative speaker terminals 25*a*, 25*b* via lead wires (tinsel wires) 26.

A damper 27 is disposed between the terminal support ring 24 and the cone paper 17 to support the voice coil 16 at a correct position in the magnetic gap 12. The damper 27 is provided with flexibility so that the damper can flexibly follow to-and-fro movement of the voice coil 16. A ring portion 28 is disposed integrally on the tip ends of the arms 23. An outer peripheral edge 17*a* of the cone paper 17 is attached to the ring portion 28.

Plural edges 17*b* are concentrically formed in the vicinity of the outer peripheral edge of the cone paper 17. The edges 17*b* are bent into a generally arcuate shape so that the cone paper 17 can smoothly vibrate and abnormal motion during vibration can be suppressed.

When a signal current flows into the voice coil 16 from the speaker terminals 25*a,* 25*b* connected to an external power source, therefore, the voice coil 16 generates a magnetic field which cooperates with the magnetic circuit 13, thereby causing the voice coil 16 to vibrate backward and forward. As a result, the cone paper 17 vibrates backward and forward to generate a sound in the form of a compressive wave of air.

Figure 5:
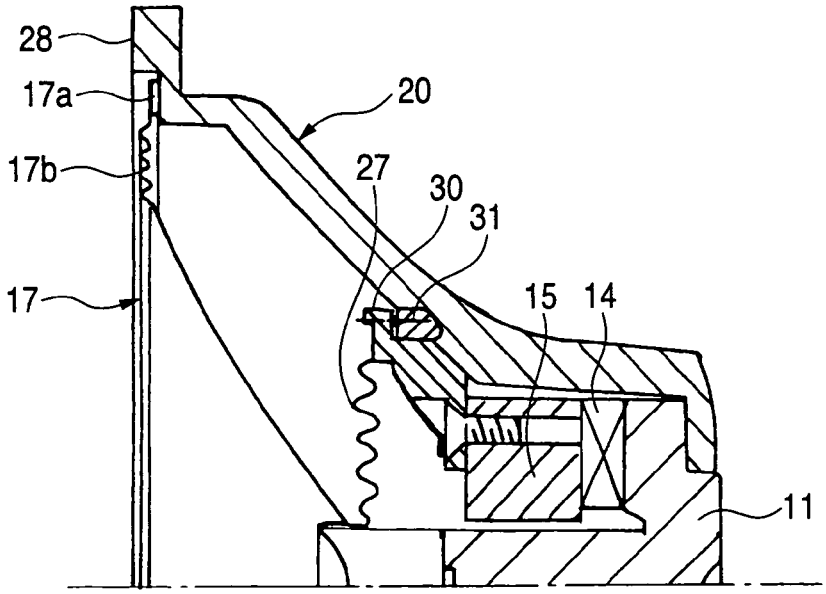
FIG. 5 is an enlarged section view showing a portion where a damper is attached to a frame via a damper holder.

FIG. 5 is an enlarged section view showing a portion where the damper 27 is attached to the frame 20. The damper 27 is attached to the frame 20 via a damper holder 30. The frame 20 and the damper holder 30 are in contact with each other via projections 31 which are disposed on one of the frame 20 and the damper holder 30. Therefore, the projections 31 may be disposed on the damper holder 30, or alternatively on the frame 20.

Figure 6A:
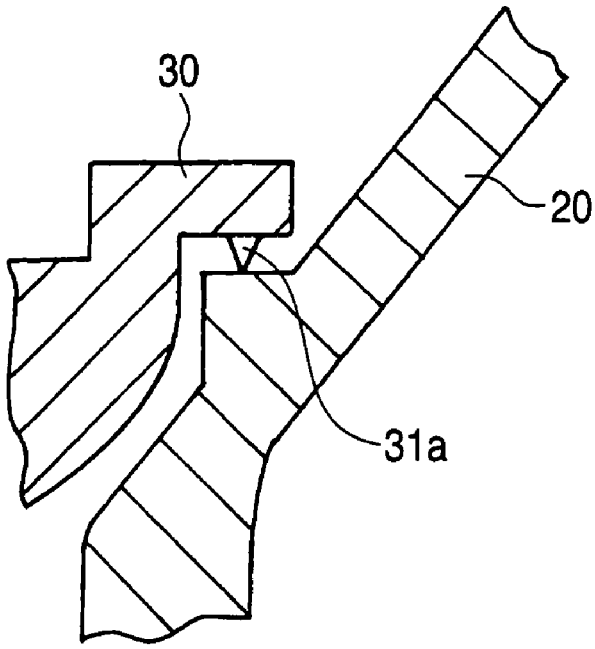
FIGS. 6A and 6B are views showing specific examples of the shape of a projection.
Figure 6B:
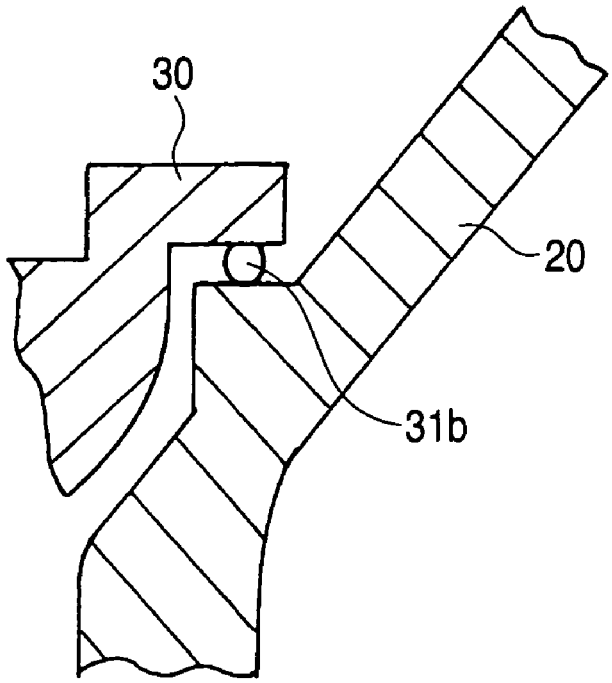

Three or more projections 31 are formed. In this case, preferably, the projections 31 are arranged at regular intervals (for example, at a center angle of 120 degrees). The projections 31 has a shape which can support a counter member at points, such as a conical shape 31*a* shown in FIG. 6A, or a spherical shape 31*b* shown in FIG. 6B. The damper holder 30 is made of a hybrid material of a resin and tungsten. Preferably, polypropylene is used as the resin. The damper holder 30 is set to have a specific gravity of 10.0 or larger.

In the speaker device 10 described above, the projections 31 are disposed on one of the damper holder 30 and the frame 20, so that the damper holder 30 and the frame 20 make point contact with each other. Therefore, propagations of resonance in the damper 27 and the frame 20 are coupled to each other through points. In the bass range, therefore, the damper holder 30 and the frame 20 are caused by the point coupling to operate in phase, and hence attenuation does not occur. By contrast, in the midrange, they operate in anti-phase, so that unwanted resonance can be attenuated.

Since a hybrid material of a resin and tungsten is used as the material forming the damper holder 30, a high specific gravity and a high attenuation can be attained. Therefore, the speaker device 10 can be increased in weight while maintaining the volume, and the reaction component of the magnetic circuit can be reduced. In the case where the damper holder 30 is made of a metal alloy, the specific gravity is 9 or smaller, and the attenuation factor is low. Therefore, it can be said that the hybrid material in the invention is superior in performance.

In order to enhance the rigidity of the damper holder 30, an aluminum die-casting is usually used. Such a damper holder 30 has an advantage that the thickness can be increased while reducing the weight. However, large resonance peculiar to the material occurs.

In order to correctly transmit a sound from the vibration system, the damper holder 30 which supports the vibration system is requested to have a larger attenuation amount and a higher specific gravity. It is an object to obtain a higher specific gravity than that of an alloy while attaining the same attenuation amount as that in the case of an alloy. Although also the use of pure tungsten has been studied, attention has been focused on a resin and tungsten, and various material compounds have been studied, with the result that a material which can accomplish the object is obtained.

The speaker device 10 of the invention is not restricted to the above-described embodiment, and may be adequately subjected to modification, improvement, or the like.

In the above-described embodiment, a speaker device of the cone type has been described. Alternatively, the invention may be similarly applied to a speaker device of the dome type.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A speaker device comprising:

a magnetic circuit including a magnet and a yoke;

a voice coil which is placed in a magnetic gap of said magnetic circuit;

a diaphragm which is vibrating available in a state where said diaphragm is coupled with said voice coil; and a damper which is placed between a portion of said diaphragm on a side of said voice coil and a housing, wherein said speaker device has a damper holder which is disposed on said housing, and to which said damper is connected, and said housing and said damper holder are in contact with each other via projections which are disposed on one of said housing and said damper holder.

2. A speaker device according to claim 1, wherein said projections are three or more in number.

3. A speaker device according to claim 1, wherein said damper holder is made of a hybrid material of a resin and tungsten.

4. A speaker device according to claim 3, wherein said resin is polypropylene.

5. A speaker device according to claim 3, wherein said damper holder has a specific gravity of 10.0 or larger.

* * * * *